US007859191B2

(12) United States Patent
Matsuzawa et al.

(10) Patent No.: US 7,859,191 B2
(45) Date of Patent: Dec. 28, 2010

(54) EXCIMER LAMPS

(75) Inventors: Satoshi Matsuzawa, Himeji (JP); Shigeki Fujisawa, Himeji (JP); Yukihiro Morimoto, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 131 days.

(21) Appl. No.: 12/248,372

(22) Filed: Oct. 9, 2008

(65) Prior Publication Data

US 2009/0096376 A1 Apr. 16, 2009

(30) Foreign Application Priority Data

Oct. 11, 2007 (JP) ..... 2007-265349

(51) Int. Cl.
*H01J 65/00* (2006.01)

(52) U.S. Cl. ..... 313/635; 313/113; 313/607; 313/234

(58) Field of Classification Search ..... None
See application file for complete search history.

(56) References Cited

U.S. PATENT DOCUMENTS 5,581,152 A * 12/1996 Matsuno et al. ..... 313/634
6,379,024 B1 * 4/2002 Kogure et al. ..... 362/263
7,468,145 B2 * 12/2008 Zukawa et al. ..... 252/301.4 R
2007/0057612 A1 3/2007 Hsu et al.
2008/0143243 A1 * 6/2008 Auday et al. ..... 313/498

FOREIGN PATENT DOCUMENTS

JP 2002-93377 A 3/2002
JP 3580233 B2 7/2004
JP 2006-139201 A 6/2006
JP 2007-335350 A 12/2007
JP 2008-66095 A 3/2008

OTHER PUBLICATIONS

European Search Report for Application No. EP 08 01 7648 Dated Feb. 26, 2009.

* cited by examiner

*Primary Examiner*—Ashok Patel
(74) *Attorney, Agent, or Firm*—Roberts Mlotkowski Safran & Cole, P.C.; David S. Safran

(57) ABSTRACT

An excimer lamp, including a discharge vessel made of silica glass and having a discharge space; a pair of electrodes disposed on the discharge vessel, wherein the discharge space is filled with xenon gas; and an ultraviolet reflection film made from ultraviolet scattering particles, including silica particles and alumina particles, formed on a surface of the discharge vessel exposed to the discharge space. A thickness Y of the ultraviolet reflection film satisfies the expression Y>4X+5, given that a mean particle diameter of the ultraviolet scattering particles making up the ultraviolet reflection film is X (μm).

2 Claims, 5 Drawing Sheets

EXCIMER LAMPS

BACKGROUND OF THE INVENTION

1. Field of the Invention

The present invention generally relates to excimer lamps, and more particularly, to excimer lamps having a discharge vessel made of silica glass, wherein an ultraviolet reflection film is formed on the surface facing a discharge space of the discharge vessel.

2. Description of Related Art

Various technologies for cleaning treatment, film forming treatment, and ashing treatment, and the like, have been developed and put into practical use recently for treating the surface of an article to be treated made of metal glass or other materials by means of action of vacuum ultraviolet radiation irradiated onto the article to be treated and the ozone generated by the vacuum ultraviolet radiation. The ultraviolet radiation is not longer than 200 nm in wavelength.

A device for emitting vacuum ultraviolet radiation typically is equipped with an excimer lamp as a light source in order to form excimer molecules by means of excimer discharge and with light being emitted from the excimer molecules. Many experiments have been attempted in order to enhance the intensity of the radiated ultraviolet radiation with more efficiency from such excimer lamps.

As shown in FIGS. 6(*a*) & 6(*b*), an excimer lamp 50 includes a discharge vessel made of silica glass, which allows passage of ultraviolet radiation, wherein electrodes 55, 56 are provided on the inner side and outer side of the discharge vessel 51 and ultraviolet reflection films are formed on the surfaces exposed to a discharge space S of the discharge vessel 51. Some technologies have been disclosed to form an ultraviolet reflection film using ultraviolet scattering particles having a high ultraviolet reflectivity, such as silica, aluminum oxide (alumina), magnesium fluoride, calcium fluoride, lithium fluoride and magnesium oxide, for example, as described in JP 3580233 B2. Such an excimer lamp is provided on part of the discharge vessel 51 with a light exit part 58 from which ultraviolet radiation generated in the discharge space S can exit because the ultraviolet reflection film 20 is not formed on that portion.

In the excimer lamp 50 having the aforementioned configuration, ultraviolet radiation generated inside the discharge space to be incident on an ultraviolet reflection film is diffused and reflected (e.g., refraction and reflection are repeated on the surface of multiple ultraviolet scattering particles) and then exited from a light exit part 58. However, in the excimer lamp including an ultraviolet reflection film having the aforementioned configuration, the ultraviolet reflection film is of an appropriate thickness in order to prevent ultraviolet radiation incident on the ultraviolet reflection film to pass through the ultraviolet reflection film, thus preventing a decline in the reflectivity of ultraviolet radiation

SUMMARY OF THE INVENTION

The present invention is based upon recognition of the fact that ultraviolet radiation can be used efficiently by setting the thickness of an ultraviolet reflection film in relation to the mean particle diameter of ultraviolet scattering particles constituting the ultraviolet reflection film Accordingly, an object of the present invention is to provide excimer lamps that allow vacuum ultraviolet radiation to exit efficiently using an ultraviolet reflection film that can efficiently reflect vacuum ultraviolet radiation generated inside the discharge space and can effectively prevent the ultraviolet reflection film from peeling off from the discharge vessel.

In an exemplary embodiment, the present invention provides an excimer lamp having a discharge vessel made of silica glass and having a discharge space, wherein a pair of electrodes is provided on both sides of the silica glass discharge vessel, the discharge space is filled with xenon gas, an ultraviolet reflection film made of ultraviolet scattering particles, including silica particles and alumina particles, is formed on the surface of the discharge vessel exposed to the discharge space and wherein the thickness Y (μm) of the ultraviolet reflection film satisfies the expression $Y>4X+5$, given that the mean particle diameter of the ultraviolet scattering particles of the ultraviolet reflection film is X (μm).

In the excimer lamp according to the present invention, the content of silica particles is preferably at least 30 wt % in the ultraviolet reflection film In the excimer lamp according to the present invention, vacuum ultraviolet radiation can be effectively reflected and diffused by the ultraviolet reflection film made of the ultraviolet scattering particles, including silica particles and alumina particles, by setting the ultraviolet reflection film to a proper thickness in relation to the mean particle diameter of ultraviolet scattering particles, and which allows vacuum ultraviolet radiation to exit efficiently. Moreover, since silica particles contained in an ultraviolet reflection film have a high adhesion to silica glass of which the discharge vessel is made, the ultraviolet reflection film is reliably prevented from peeling off from the discharge vessel.

DETAILED DESCRIPTION OF THE INVENTION

Figure 1A:
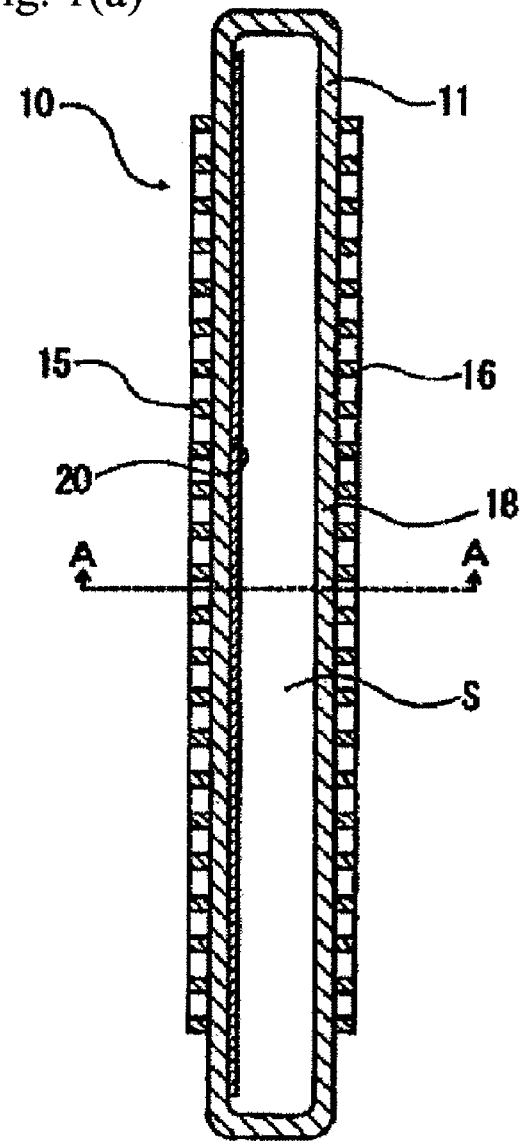
FIGS. 1(*a*)-1(*b*) are sectional views showing a schematic configuration of an excimer lamp according to one embodiment of the present invention, wherein FIG. 1(*a*) is a cross-sectional view along a longitudinal direction of a discharge vessel, and FIG. 1(*b*) is a sectional view taken alone line A-A in FIG. 1(*a*)
Figure 1B:
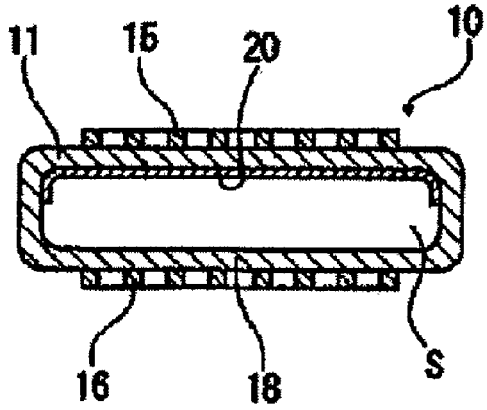

FIGS. 1(*a*)-l(*b*) are sectional views showing a schematic configuration of an excimer lamp according to one embodiment of the present invention, wherein FIG. 1(*a*) is a cross-sectional view along a longitudinal direction of a discharge vessel, and FIG. 1(*b*) is a sectional view taken along line A-A in FIG. 1(*a*). In FIGS. 1(*a*)-1(*b*), an excimer lamp 10 includes a long and hollow discharge vessel 11 whose cross-section is rectangular and wherein both ends thereof are hermetically sealed so that a discharge space is formed therein.

The inside of the discharge vessel 11 is filled with xenon gas and the discharge vessel 11 is made of silica glass (e.g., synthetic quartz glass) that allows the passage of vacuum ultraviolet radiation as well as functioning as a dielectric. On the outer surface of the discharge vessel 11, on the long side thereof, there is provided a pair of electrodes (e.g., an electrode 15, which functions as a high voltage supply electrode, and the other electrode 16, which functions as a grounded electrode) arranged in such a way so as to extend along the long side of the discharge vessel 11 and facing each other. Accordingly, the discharge vessel 11, which functions as a dielectric, is placed between the pair of the electrodes 15, 16. The electrodes 15, 16 can formed by paste-coating the discharge vessel 11 with metallic electrode material or by means of circuit printing operations.

In the excimer lamp 10, discharge occurs between electrodes 15, 16 via the walls of the discharge vessel 11, which functions as a dielectric, after electric 15. As a result, excimer molecules are formed, and at the same time, excimer discharge occurs so that vacuum ultraviolet radiation, for example, having a peak in the vicinity of a wavelength of 170 nm, is emitted from the excimer molecules. In order to efficiently use the vacuum ultraviolet radiation generated by the excimer molecules, an ultraviolet reflection film 20 is provided on the inner surface of the discharge vessel 11.

The ultraviolet reflection film 20 is, for example, formed on the inner surface area of the discharge vessel 11 on the long side thereof on which the electrode 15, which functions as the high voltage supply electrode, is provided, and on the inner surface areas of the vessel on the short sides thereof continuously from the aforementioned inner surface area on the long side thereof The light exit part (also referred to as an aperture part) 18 is formed on the inner surface area of the discharge vessel 11 on the long side thereof on which the other electrode 16, which functions as the grounded electrode, is provided by not providing the ultraviolet reflection film 20 thereon.

The ultraviolet reflection film 20 is made of ultraviolet scattering particles, including silica particles and alumina particles. The ultraviolet reflection film 20 can be formed from a mixture of alumina particles and silica particles (e.g., a stack of silica particles and alumina particles)

Since silica particles and alumina particles have a high refractivity and vacuum ultraviolet radiation transmission properties, the ultraviolet reflection film 20 can function to "diffuse reflection", wherein part of the vacuum ultraviolet radiation that has reached the silica particles or aluminum particles is reflected on the surface of the particles and the other part thereof is refracted and incident on the particles, such that a large portion of the light incident on the particles is transmitted (a portion is also absorbed) and refracted again at the time of exiting from the particles, thus repealing the reflection and refraction processes. Advantageously, the ultraviolet reflection film 20 does not generate gaseous impurities and can withstand discharge because it is made of ceramic (e.g., formed by the silica particles and the alumina particles).

Silica particles making up the ultraviolet reflection film 20 may be in any state, including a glass state and a crystal state. Nevertheless, it is preferred that silica particles are in the glass state (e.g., silica glass pulverized into powdery fine particles). The particle size, as defined below, of silica particles is in the range of 0.01 to 20 μm, for example. The mean particle diameter (e.g., a peak value of a number average of particle diameters) is preferably in the range of 0.1 to 10 μm, and more preferably, in the range of 0.3 to 3 μm. It is also preferable that silica particles having the mean particle diameter account for at least 50% of the Silica particles.

The "particle size" of the silica particles and alumina particles making up the ultraviolet reflection film 20 refers to the Feret's diameter, which is an interval between two parallel lines of a specific direction on both sides of any particle on an enlarged projected image, wherein the enlarged projected image is obtained under a scanning electron microscope (SEM) on a broken section obtained by breaking the ultraviolet reflection film 20 in the perpendicular direction of its surface, and with the observation range being approximately in the middle of the thickness direction.

Figure 2A:
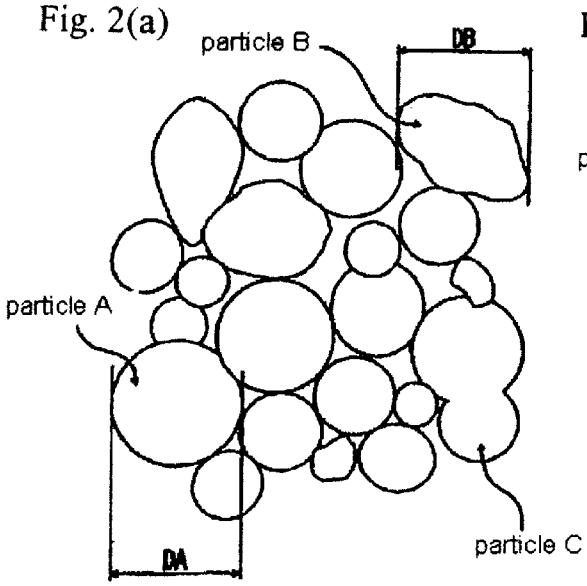
FIGS. 2(*a*)-2(*b*) are explanatory views for defining diameters of silica particles and alumina particles.
Figure 2B:
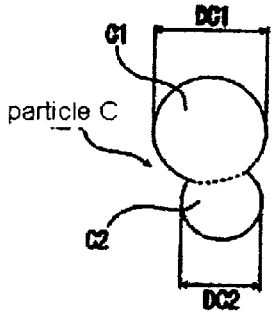

Specifically, as shown in FIG. 2(*a*), the particle size DA or DB is an interval between two parallel lines of a specific direction (e.g., in the thickness direction or the Y-axis direction) of the ultraviolet reflection film 20 on both sides of a substantially spherical particle A or on long sides of a non-round particle shaped particle B, respectively.

In the case of a particle C having a shape formed by melting and then connecting starting particles, as shown in FIG. 2(*b*), the particle size DC1 or DC2 is measured as an interval between two parallel lines of a specific direction (e.g., in the thickness direction of the ultraviolet reflection film 20) on both sides of the portion which is believed to be the starting particle C1 or C2, respectively.

The "mean particle diameter" of silica particles and alumina particles making up the ultraviolet reflection film 20 refers to a mean value in a portion in which the number of particles (i.e., counting) is maximal, wherein a range between the maximum and minimum values of particle sizes measured as described above is divided into multiple portions (e.g., 15 portions) at intervals of 0.1 μm. Advantageously, the silica particles and alumina particles having particle sizes in the aforementioned range that is substantially equivalent to the wavelength of vacuum ultraviolet radiation can reflect and diffuse vacuum ultraviolet radiation efficiently.

In the aforementioned excimer lamp 10, the content of silica particles included in the ultraviolet reflection film 20 is preferably at least 30 wt %, for example, and more preferably, at least 40 wt %. As a result, the ultraviolet reflection film 20 can have a high adhesion to the discharge vessel 11, which can effectively prevent the ultraviolet reflection film 20 from peeling off from the discharge vessel.

In the ultraviolet reflection film 20, the content of alumina particles is preferably at least 1 wt % of the total sum of silica particles and alumina particles, for example, more preferably 5 wt %, and yet more preferably, at least 10 wt % and not more than 70 wt %. Since alumina particles have a higher refractivity than that of silica particles, the ultraviolet reflection film 20 containing alumina particles has a higher refractivity than a film only made of silica particles.

In the aforementioned excimer lamp 10, the thickness Y (μm) of the ultraviolet reflection film 20 satisfies the expression $Y>4X+5$, given that the mean particle diameter of ultraviolet scattering particles making up the ultraviolet reflection film is X (μm).

If the particle size of the ultraviolet scattering particles is too large relative to the thickness of the ultraviolet reflection film 20, it is most likely that the vacuum ultraviolet radiation incident on the ultraviolet reflection film 20 passes through the ultraviolet reflection film 20, because the density of the ultraviolet scattering particles becomes small in the ultraviolet reflection film 20, and which may lead to a decline in reflectivity. In the case that the particle size of the ultraviolet scattering particles is small, the vacuum ultraviolet radiation incident on the ultraviolet reflection film 20 can sufficiently be reflected and diffused, even though the thickness of the ultraviolet reflection film 20 is made small. Accordingly, the lower limit (required film thickness) of the ultraviolet reflection film 20 is not an absolute value, but should be set in relation to the mean particle diameter of the ultraviolet scattering particles.

If the thickness of the ultraviolet reflection film 20 is made large, there is a tendency that reflectivity goes up. However, reflectivity does not increase further if the thickness exceeds a certain level. On the other hand, as the thickness of the ultraviolet reflection film 20 increases, a voltage applied to the discharge space S filled with discharge gas inside the discharge vessel 11 declines. There occurs a problem, therefore, that the starting voltage of the excimer lamp becomes too high that the lamp cannot be lit. Moreover, the ultraviolet reflection film 20 becomes liable to be peeled off, if the film thickness is too large. In addition, a problem may occur in that the ultraviolet reflection film 20 is peeled off, for example, by vibration while transporting the lamp. Therefore, the upper limit of the thickness of the ultraviolet reflection film 20 needs to be set in such a way that the aforementioned problems can be effectively prevented and so that, at the same time, sufficient reflectivity can be achieved (e.g., 1000 μm).

The ultraviolet reflection film 20 can be formed by a "flow-down method," for example. That is, a liquid dispersion is first prepared by blending silica particles or silica particles and alumina particles with a viscous solvent of water and PEO (polyethylene oxide) resin This liquid dispersion is poured into the discharge vessel 11 so to it can adhere to a specified portion on the inner surface of tie discharge vessel for forming the ultraviolet reflection film material. The ultraviolet reflection film 20 then can be formed by drying and then baking the discharge vessel so that the water and the PEO resin can be evaporated. The thickness of the ultraviolet reflection film 20 can be adjusted by controlling the viscosity of liquid dispersion. For example, the ultraviolet reflection film 20 can be made thin by decreasing viscosity, and the ultraviolet reflection film 20 can be made thick by increasing viscosity.

Any suitable method can be used for manufacturing silica particles and alumina particles in order to form the ultraviolet reflection film 20, which includes solid, liquid and vapor phase processes. Among these methods, the vapor phase process and particularly the chemical vapor deposition process (CVD) is preferred in terms of the reliable production of particles of micron or submicron size. Specifically, silica particles can be synthesized by reacting silicon chloride with oxygen at 900 to 1000° C. Alumina particles can be synthesized by reacting aluminum chloride with oxygen at 1000 to 1200° C. The particle size can be adjusted by controlling the concentration of the raw material, the pressure in the reaction field, and the reaction temperature.

In the excimer lamp 10 having the aforementioned configuration, vacuum ultraviolet radiation can be effectively reflected and diffused by an ultraviolet reflection film 20 made up of ultraviolet scattering particles, including silica particles and alumina particles, by setting the ultraviolet reflection film 20 to a proper thickness in relation to the mean particle diameter of the ultraviolet scattering particles, and which allows vacuum ultraviolet radiation to be emitted efficiently. Moreover, since silica particles included in the ultraviolet reflection film 20 have a high adhesion to the silica glass of the discharge vessel 11, the ultraviolet reflection film 20 is reliably prevented from peeling off from the discharge vessel 11.

In general, it is well known that plasma is generated from an excimer lamp as a result of excimer discharge. In the excimer lamp having the aforementioned configuration, however, the temperature of the ultraviolet reflection film rapidly increases locally, because plasma is incident on the ultraviolet reflection film substantially at right angles. If the ultraviolet reflection film is made only of silica particles, for example, the silica particles are melted by the heat of the plasma, resulting in the disappearance of particle boundaries. As a result, the vacuum ultraviolet radiation cannot be reflected and diffused, which may lead to a decline in reflectivity.

In the excimer lamp 10 having the aforementioned configuration, since the ultraviolet reflection film 20 is made of silica particles and alumina particles, and the mean particle diameter of silica particles is within a specified range relative to the mean particle diameter of alumina particles, advantageously, particles boundaries remain unchanged, even if they are heated by plasma This is because alumina particles, which have a higher melting point than silica particles, are not melted, and therefore the silica particles and alumina particles that are contiguous to each other cannot be combined. In the case of lighting for an extended period of time, vacuum ultraviolet radiation can be reflected and diffused efficiently, and therefore the initial reflectivity can be maintained. As a result, vacuum ultraviolet radiation is allowed to be exited efficiently. Moreover, the adhesion (e.g., binding properties) of the ultraviolet reflection film 20 to the discharge vessel 11 does not significantly decline by virtue of the addition of alumina particles, which reliably prevents the ultraviolet reflection film 20 from peeling off from the discharge vessel 11.

Furthermore, fee ultraviolet reflection film 20 formed on the inner surface of the discharge vessel 11, which is exposed to the discharge space S where excimer emission is generated, allows reducing the damage caused by ultraviolet distortions arising from vacuum ultraviolet radiation inside the discharge space S, which is incident on silica glass of the portion other than the light exit part 18. Thus, the generation of cracks, advantageously, can be prevented.

Descriptions of exemplary embodiments, which are carried out to confirm the effect of the present invention, are given below.

In accordance with the configuration as shown in FIG. 1, 7 types of excimer lamps were made and having the same configuration except for the configuration of the ultraviolet reflection film, as shown in Table 1 below, wherein the thicknesses of the ultraviolet reflection film was changed within the range of 1 to 80 μm. A description of the basic configuration of the excimer lamps is given below.

The discharge vessel is made of synthetic quartz glass. The dimension of the discharge vessel is 10×42×150 mm The thickness is 2.5 mm The discharge gas filled in the discharge vessel is xenon gas. The amount is 40 kPa. The size of the high voltage supply electrode and grounded electrode is 30×100 mm. In the ultraviolet reflection film, silica particles having the mean particle diameter account for 50% of the particles. Alumina particles having the mean particle diameter also account for the other 50% of the particles. Ultraviolet reflection films were formed by the flow-down method at 1000° C. of baking temperature.

The particle size of silica particles and alumina particles are not that of the starting material but rather that of the ultraviolet reflection film. The size of silica particles and alumina particles were measure using a field emission type scanning electron microscope "S4100" manufactured by Hitachi Ltd. The acceleration voltage was 20 kV. An enlarged projected image with a magnifying power of 20000 for particles of 0.05 to 1 μm and a magnifying power of 2000 for particles of 1 to 10 μm was observed.

TABLE 1

| | | Constituent material | Range of particle sizes [μm] | Mean particle diameter [μm] | Composition ratio [wt %] |
|---|---|---|---|---|---|
| Excimer lamp 1 | Ultraviolet reflection film 1 | Silica particles | 0.05 to 0.5 | 0.2 | 90 |
| | | Alumina particles | | | 10 |
| Excimer lamp 2 | Ultraviolet reflection film 2 | Silica particles | 0.1 to 2 | 0.5 | 90 |
| | | Alumina particles | | | 10 |
| Excimer lamp 3 | Ultraviolet reflection film 3 | Silica particles | 0.1 to 2 | 0.5 | 80 |
| | | Alumina particles | | | 20 |
| Excimer lamp 4 | Ultraviolet reflection film 4 | Silica particles | 0.1 to 9 | 2 | 90 |
| | | Alumina particles | | | 10 |
| Excimer lamp 5 | Ultraviolet reflection film 5 | Silica particles | 0.15 to 12 | 4 | 90 |
| | | Alumina particles | | | 10 |
| Excimer lamp 6 | Ultraviolet reflection film 6 | Silica particles | 0.15 to 12 | 4 | 80 |
| | | Alumina particles | | | 20 |
| Excimer lamp 7 | Ultraviolet reflection film 7 | Silica particles | 1 to 15 | 7 | 90 |
| | | Alumina particles | | | 10 |

Figure 3:
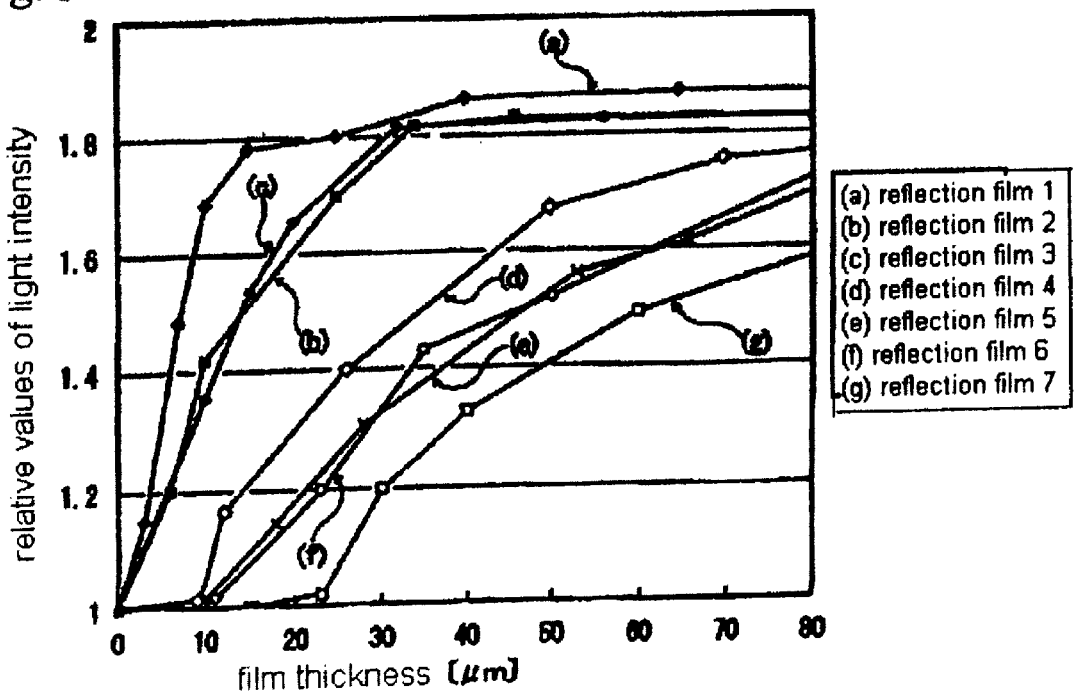
FIG. 3 is a graph showing measured results of relative illuminance for each excimer lamp of various exemplary is embodiments.
Figure 4:
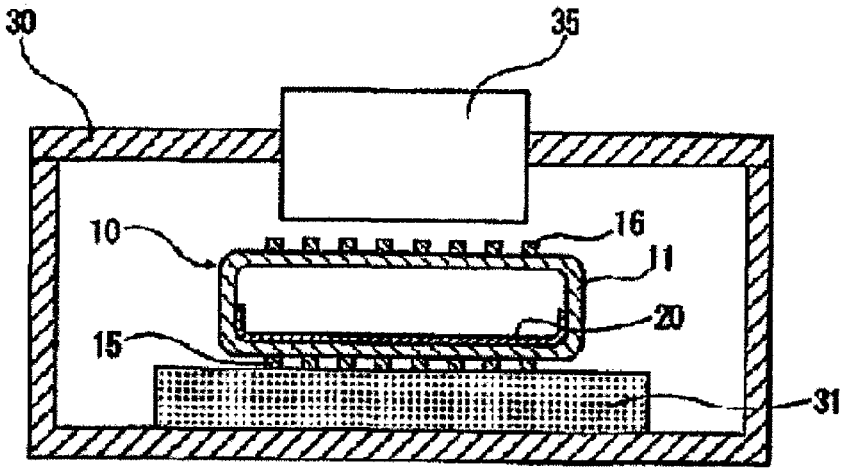
FIG. 4 is a sectional view for explaining a method of measuring illuminance of an excimer lamp of an exemplary embodiment.

The intensity of vacuum ultraviolet radiation in the range of 150 to 200 nm in wavelength to find relative values of illuminance was measured, given that the illuminance of an excimer lamp provided with no ultraviolet reflection film is 1 in the same wavelength range. FIG. 3 shows the results. A description of the measuring of the illuminance is given below by referring to FIG. 4, wherein an excimer lamp 10 was fixed on a support 31 made of ceramic placed inside a container 30 made of aluminum. An ultraviolet illumination photometer 35 also was fixed at a position facing the excimer lamp 10 and 1 mm away from the surface of the excimer lamp 10. The inside of the container 30 was made from aluminum, and under a nitrogen atmosphere a high voltage alternating current of 5 kV was applied between the electrodes 15 and 16 of the excimer lamp 10 in order to generate discharge inside the discharge vessel 11. The intensity of vacuum ultraviolet radiation in the range of 150 to 200 nm in wavelength emitted through the mesh of the other electrode (e.g., the grounded electrode) 16 was then measured.

It is believed that it is acceptable, as practical use, if the illuminance of an excimer lamp provided with an ultraviolet reflection film is not less than 20% higher than that of an excimer lamp with no ultraviolet reflection film (e.g., relative illuminance values are not less than 1.2). Accordingly, the thickness of an ultraviolet reflection film required for making relative illuminance values not less than 1.2 (e.g., the required film thickness) based on FIG. 3 was determined. Table 2 below shows the results of the experiment.

TABLE 2

| Excimer lamps | Ultraviolet reflection films | Required film thickness [μm] |
|---|---|---|
| Excimer lamp 1 | Ultraviolet reflection film 1 | 4 |
| Excimer lamp 2 | Ultraviolet reflection film 2 | 6 |
| Excimer lamp 3 | Ultraviolet reflection film 3 | 6 |
| Excimer lamp 4 | Ultraviolet reflection film 4 | 14 |
| Excimer lamp 5 | Ultraviolet reflection film 5 | 22 |
| Excimer lamp 6 | Ultraviolet reflection film 6 | 23 |
| Excimer lamp 7 | Ultraviolet reflection film 7 | 30 |

Figure 5:
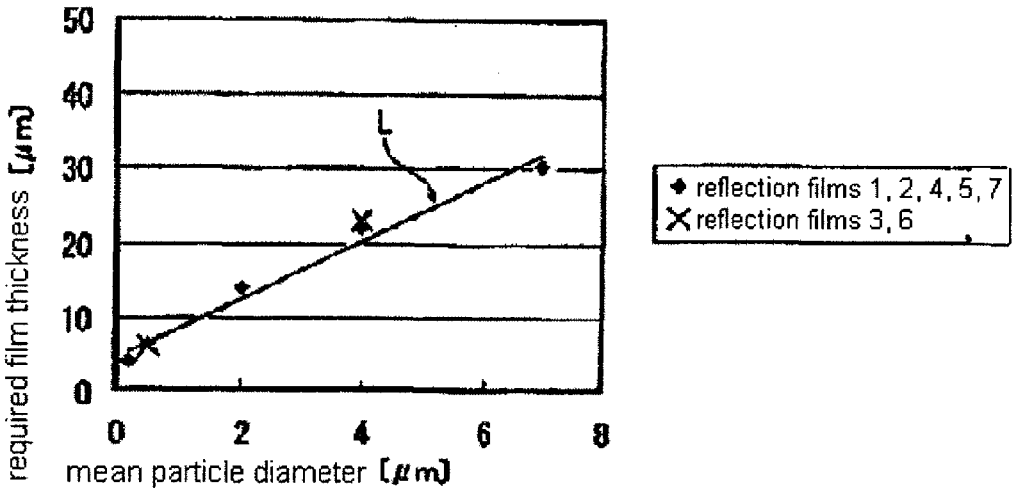
FIG. 5 is a graph showing a relationship between a mean particle diameter of ultraviolet scattering particles and a required film thickness of an ultraviolet reflection film when relative illuminance values are at least 1.2.

As shown in FIG. 5, the required film thickness of the ultraviolet reflection firms is linearly related to the mean particle diameters of the ultraviolet scattering particles (e.g., silica particles and alumina particles) making up the ultraviolet reflection films. Those factors can be approximated with a straight line. It was confirmed that an ultraviolet reflection film can keep the initial reflection characteristics and vacuum ultraviolet radiation can be emitted efficiently if the thickness Y (μm) (required film thickness) of the ultraviolet reflection film, which allows not less than 1.2 for relative illuminance values, is in the region above the approximate line L, as shown by the equation $$Y=4X+5 \text{(e.g., } Y>4X+5\text{)}.$$

As for the excimer lamp 5 made in the previous embodiment above, 6 types of excimer lamps (5, 8 to 12) having the same basic configuration as the excimer lamp 5 used in the previous embodiment were made, except that the content of silica particles and alumina particles making up the ultraviolet reflection firms were varied as shown in Table 3 below. Then, visually observed was the presence or absence of peeling of the ultraviolet reflection film for each excimer lamp. Table 3 below shows the results.

TABLE 3

| | Constituent material | | |
|---|---|---|---|
| | Silica particles | Alumina particles | Peeling of an ultraviolet reflection film |
| Excimer lamp 5 | 90 wt % | 10 wt % | ○: No peeling |
| Excimer lamp 8 | 60 wt % | 40 wt % | ○: No peeling |
| Excimer lamp 9 | 40 wt % | 60 wt % | ○: No peeling |
| Excimer lamp 10 | 30 wt % | 70 wt % | ○: No peeling |
| Excimer lamp 11 | 25 wt % | 75 wt % | Δ: Peeled in some lamps |
| Excimer lamp 12 | 20 wt % | 80 wt % | X: Peeled in all the lamps |

Thus, it was confirmed that an ultraviolet reflection film was not peeled, if the content of silica particles was at least 30 wt % in the ultraviolet reflection film.

So far, several embodiments of the present invention have been described and explained. However, the present invention is not limited to such embodiments, as a wide range of variations are possible, according to further embodiments. For example, the present invention is not limited to excimer lamps having the aforementioned configurations, but can be applied to excimer lamps having the known double-tube structure shown in FIGS. 6(*a*) & 6(*b*) and to angular-type excimer lamps, as shown in FIG. 7.

Figure 6A:
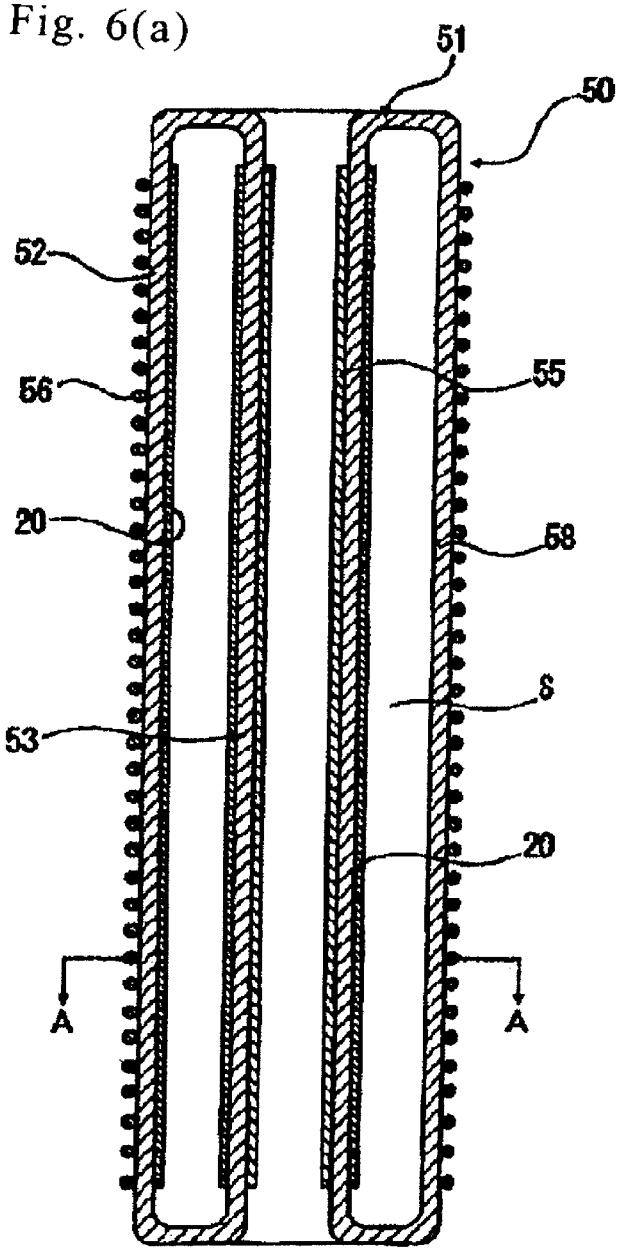
FIGS. 6(*a*)-6(*b*) are sectional views showing a schematic configuration of a known excimer lamp which is adapted in accordance with another embodiment of the present invention, wherein FIG. 6(*a*) is a cross-sectional view along a longitudinal direction of a discharge vessel, and FIG. 6(*b*) is a sectional view taken along line A-A in FIG. 6(*a*).
Figure 6B:
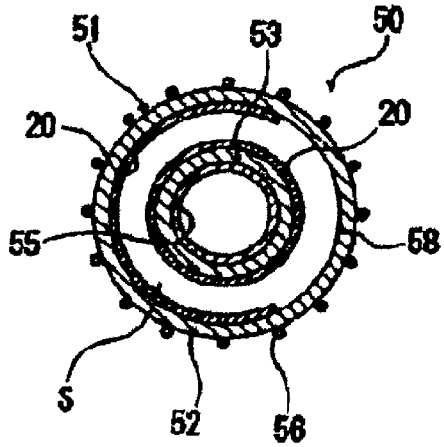

The excimer lamp 50, as shown in FIGS. 6(*a*)-6(*b*), for example, includes a circular outer tube 52 made of silica glass, and a circular inner tube 53 made of silica glass, which is arranged inside the outer tube 52, along the axis of the tube and that has an outside diameter smaller than the inside diameter of the outer tube 52, wherein both edges of the outer tube 52 and the inner tube 53 are fused in such a way as to form a discharge vessel 51 of a double-tube structure having an annular discharge space S between the outer tube 52 and the inner tube 53. An electrode (e.g., a high voltage supply electrode) 55 made of metal, for example, is closely provided on the inner circumference of the inner tube 53. The other electrode 56 made of a conductive material, such as metal, is closely provided on the outer circumference of the outer tube 52. The inside of the discharge space S is filled with discharge gas, such as xenon gas, which allows forming of the excimer molecules by means of excimer discharge.

In the excimer lamp 50 having the aforementioned configuration, the aforementioned ultraviolet reflection film 20 is provided on the entire interior surface of the inner tube 53 in the discharge vessel 51. The ultraviolet reflection film 20 made of silica particles and alumina particles is also provided on the interior surface of the outer tube 52, excluding a portion forming a light exit part 58.

Figure 7A:
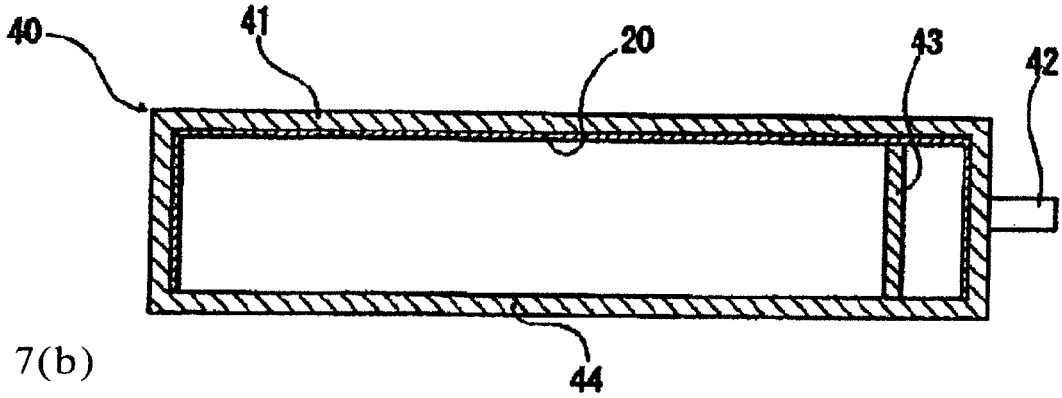
FIGS. 7(*a*)-7(*b*) are sectional view showing a schematic configuration of an excimer lamp according to yet another embodiment of the present invention, wherein FIG. 7(*a*) is cross-sectional view along a longitudinal direction of a discharge vessel, and FIG. 7(*b*) is a sectional view perpendicular to the view of FIG. 7(*a*).
Figure 7B:
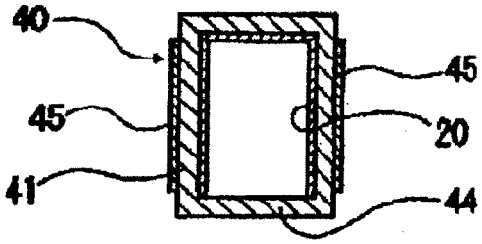

The excimer lamp 40, as shown in FIGS. 7(*a*)-7(*b*) includes a discharge vessel 41 having a rectangular cross section made of synthetic silica glass, for example. A pair of outer electrodes 45 and 45 made of metal is provided on the exterior surface of the discharge vessel 41 facing each other along the axial direction of the tube of the discharge vessel 41. The discharge vessel 41 is filled with discharge gas (e.g., xenon gas). In FIG. 7, the reference numeral 42 is an exhaust tube, and the reference numeral 43 is a getter made of barium, for example.

In the excimer lamp 40 having the aforementioned configuration, the aforementioned ultraviolet reflection film 20 is provided on the inner areas corresponding to the outer electrodes 45, 45 and another inner area, which is connected to the aforementioned areas corresponding to the electrodes, and a light exit part 44 is formed by not providing the ultraviolet reflection film 20 thereon.

What is claimed is:

1. An excimer lamp, comprising:

a discharge vessel made of silica glass and having a discharge space filled with xenon gas;

a pair of electrodes disposed on the discharge vessel, and an ultraviolet reflection film made from ultraviolet scattering particles, the ultraviolet reflection film including silica particles and alumina particles, formed on a surface of the discharge vessel exposed to the discharge space, wherein a thickness of the ultraviolet reflection film Y satisfies the expression:

$$Y>4X+5,$$

where X (μm) is the mean a-particle diameter of the ultraviolet scattering particles making up the ultraviolet reflection film.

2. The excimer lamp of claim 1, wherein a content of the silica particles in the ultraviolet reflection film is at least 30 wt %.

* * * * *